US005611178A

United States Patent [19]

Aubert

[11] Patent Number: 5,611,178

[45] Date of Patent: Mar. 18, 1997

[54] DEVICE FORMING AN UNDERGROUND SHELTER FOR THE PROTECTION OF PERSONS AND METHOD FOR MAKING SAME

[75] Inventor: Henri Aubert, La Seyne Sur Mer, France

[73] Assignee: Constructions Industrielles de la Mediterranee - CNIM, Paris, France

[21] Appl. No.: 418,742

[22] Filed: Apr. 7, 1995

[30] Foreign Application Priority Data

Aug. 4, 1994 [FR] France ..... 94 04206

[51] Int. Cl.[6] ..... E04H 15/00

[52] U.S. Cl. ..... 52/169.6; 52/86; 135/901; 135/97; 135/115; 109/1 S

[58] Field of Search ..... 52/159.6, 86; 135/900, 135/901, 903, 906, 115, 97; 109/1 S

[56] References Cited

U.S. PATENT DOCUMENTS

| | | | |
|---|---|---|---|
| 3,609,905 | 10/1971 | Fuhrman et al. | 135/901 X |
| 4,222,401 | 9/1980 | Allweil | 52/169.6 X |
| 4,885,812 | 12/1989 | Lindner | 135/903 X |
| 5,385,423 | 1/1995 | Abukawa | 52/86 X |

FOREIGN PATENT DOCUMENTS

| | | | |
|---|---|---|---|
| 0106025 | 3/1927 | Austria | 52/86 |
| 0654505 | 12/1962 | Canada | 135/901 |
| 1163524 | 2/1964 | Germany | 52/86 |
| 1634497 | 6/1970 | Germany . | |
| 0292214 | 6/1928 | United Kingdom | 135/900 |
| 509439 | 7/1939 | United Kingdom . | |
| 0520326 | 4/1940 | United Kingdom | 109/1 S |
| 526586 | 9/1940 | United Kingdom . | |
| 535471 | 4/1941 | United Kingdom . | |
| 2111555 | 7/1983 | United Kingdom . | |

*Primary Examiner*—Carl D. Friedman
*Assistant Examiner*—Winnie Yip
*Attorney, Agent, or Firm*—Pennie & Edmonds

[57] ABSTRACT

An underground shelter for the protection of at least one person, comprising two substantially identical rigid panels which may be assembled together into a tunnel configuration and disassembled by distinct mechanical means arranged so as to permit a joined interfitting of both top parts of both panels, respectively, and a rigid connection between the bottom parts of the latter so that the buried panel may withstand side or transverse forces applied to the panel and resulting from the thrust exerted by the earth layer covering the tunnel.

19 Claims, 7 Drawing Sheets

3
4
5
6
7
8
8a
8a1
8a2
8b
9
12
14
V
VI
VII

FIG. 11
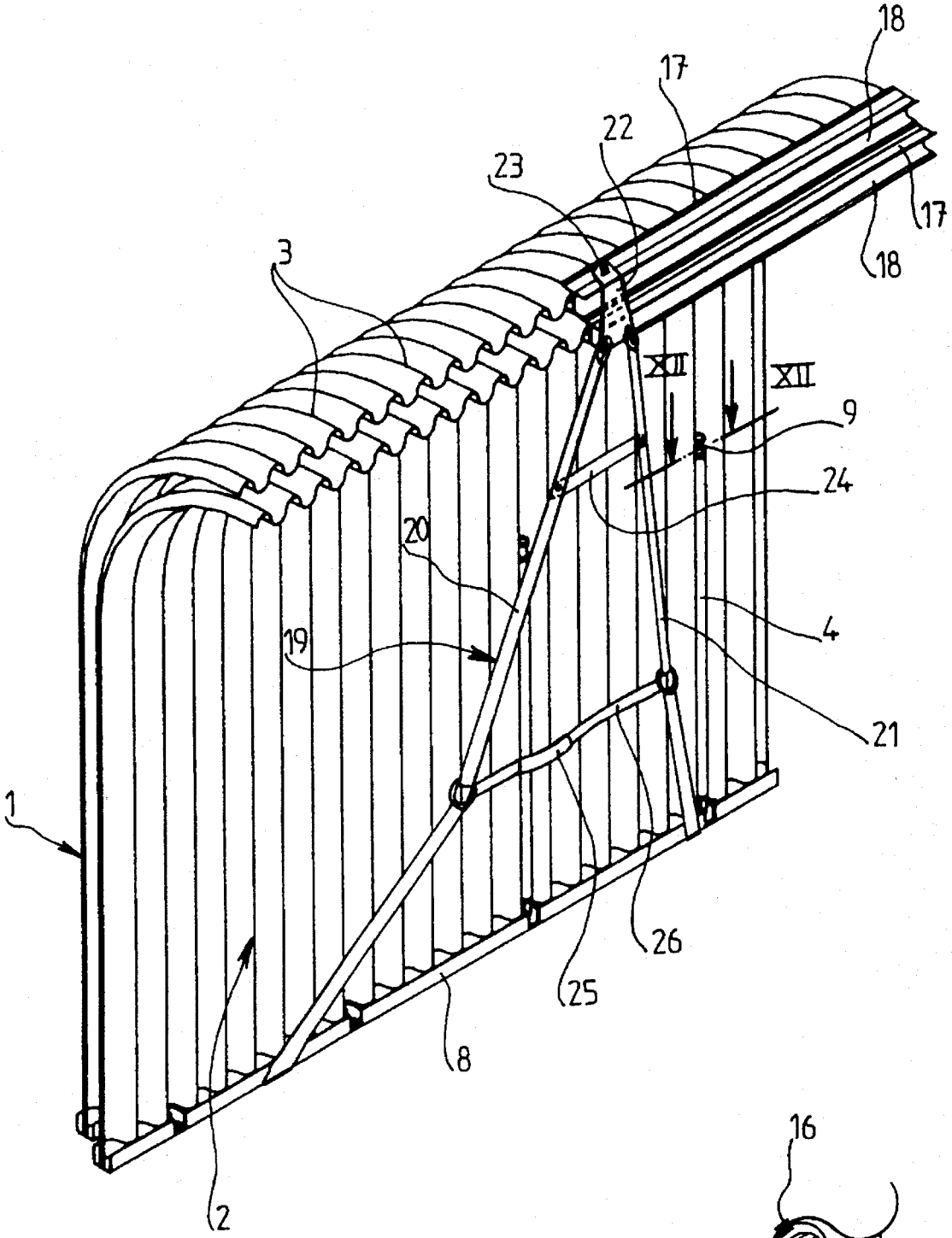
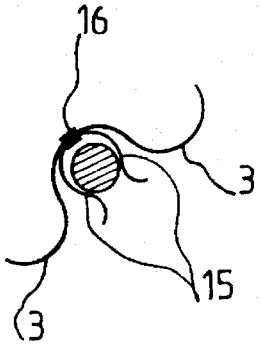
FIG. 12

DEVICE FORMING AN UNDERGROUND SHELTER FOR THE PROTECTION OF PERSONS AND METHOD FOR MAKING SAME

SUMMARY OF THE INVENTION

The present invention relates to a device forming an underground shelter for the protection of persons and a method of making same.

It is directed in particular to such a buried device providing a protection of soldiers against the explosion of a shell falling near the device.

For that purpose the device according to the invention is characterized in that it comprises two substantially identical rigid panels which may be assembled together into a tunnel configuration which may be dismantled by distinct mechanical means arranged so as to permit a joined or close interfitting of the two upper parts of the two panels, respectively, defining the vault of the tunnel and a rigid connection between the lower parts of the two panels in order that the tunnel buried or hidden into the ground may withstand side or transverse forces applied onto the panels and resulting from the thrust exerted by the earth layer covering the tunnel.

Preferably the mechanical means for the connection of the lower parts of both panels comprise at least two elements forming cross-members with identical lengths having each one one of their ends connected in a pivotally connected manner to the lower part of one of the panels and their opposite end removably fastened to the upper part of the other panel.

The fastening end of each cross-member element comprises a frusto-conical end portion insertable into a mating or complementary frusto-conical aperture of a piece affixed to the lower part of the corresponding panel, the frusto-conical end portion being firmly held in its corresponding aperture by the transverse thrust force of the covering earth.

Advantageously the affixed piece comprises a stop-like portion co-operating with a collar made fast to or integral with the frusto-conical end portion behind the latter to hold the cross-member element against motion in relation to the corresponding panel.

The affixed piece has approximately the shape of a recessed cube hollowed out so as to permit the insertion of the end of the cross-member element into the piece from above the latter and the stop-like portion is formed in the bottom wall of the cube of the affixed piece and extends at right angles to and between those side walls of this cube which extend transversely of the corresponding panel whereas the frusto-conical aperture is formed in the end wall of the cube and is adjacent to the panel.

Each cross-member element is movable in a plane perpendicular to that of the panel to which it is pivotally connected and may be swung back onto this panel into an inoperative transport position.

The cross-member element is held in inoperative position by two elastic legs approximately in the shape of Ω, fastened to the panel for instance by a rivet and receiving the end with the frusto-conical end portion of the cross-member element.

The end of each cross-member element is pivotally connected to the corresponding panel through the medium of a yoke-shaped member secured to this panel.

The lower parts of both panels are fastened into two longitudinal girders or stringers, respectively, with a U-shaped cross-section which constitute together with the cross-member elements fastened between the panels, a frame supporting the latter.

The aforesaid affixed pieces are fastened for instance as by welding into the longitudinal girders or stringers which comprise channel-like cut-outs or recesses formed in both mutually confronting side walls or flanges of the girders to permit the fastening of the cross-member elements between the panels substantially in a same plane perpendicular to the panels.

The aforesaid mechanical interfitting means comprise at least one beam with two opposite side grooves preferably defined by two identical U-shaped sectional channel members made fast together with their base webs, at least one end portion of the upper vault part of a panel being fastened into one of the two grooves of the beam and at least one end portion of the upper vault part of the other panel fitting into the other groove of the beam.

The mechanical interfitting means comprise two identical beams fastened to the top end portions of both panels, respectively, while extending over one half of the length of the panel so that the free top end portion of a panel fits into the beam of the other panel and vice-versa.

Both panels are nested into each other in the position of transport by a person to the place of burying and both nested panels are transported through the medium of a harness.

The aforesaid harness is arranged for at the same time keeping both panels nested into each other during the transport and permitting their transport in a position maintained slightly inclined with respect to the body of the person.

According to one embodiment the harness comprises two laces for fastening both nested panels and which are connected together to a common brace removably fastened to the beam of the upper panel and fastened with their two spaced lower ends to the girder of the outer panel; an upper strap fastened between both laces; and a lower handling or conveyance handle also fastened between both laces at some distance from the strap so that the person may transport both nested panels by grasping the conveyance handle with the strap accommodated under his arm.

Advantageously the upper vault portion of each panel has the shape of one half arch imparting to the tunnel vault the shape of a cylindrical cap.

Each panel comprises corrugations or flutes like a corrugated or fluted metal sheet and is made from a glass fiber-based material whereas the beams, the girders, the cross-member elements and the affixed pieces are made from a light material such as aluminum.

The invention also provides a method of making an underground protection shelter using the device previously defined and which is characterized in that it consists in:

carrying through a person both nested panels to a place where the shelter should be buried or hidden into the ground;

digging an excavation for burying the shelter;

separating the two nested panels from each other;

inserting both separated panels into the excavation in a substantially vertical position;

fastening the cross-member elements between both panels by swinging them downwards and inserting their fastening ends into the corresponding affixed pieces so that the frusto-conical end portions be inserted into the frusto-conical openings, respectively, of these affixed pieces;

joining both panels at their top parts through fitting into each corresponding beam; and covering the shelter thus formed with earth and if need be with protection bags above the shelter.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non-limiting example only illustrating one presently preferred specific embodiment of the invention and wherein:

FIG. 11 is a perspective view of two panels nested into each other of the device of the invention;

FIG. 12 is an enlarged view in cross-section taken upon the line XII—XII of FIG. 11.

DETAILED DESCRIPTION OF THE INVENTION

Figure 1:
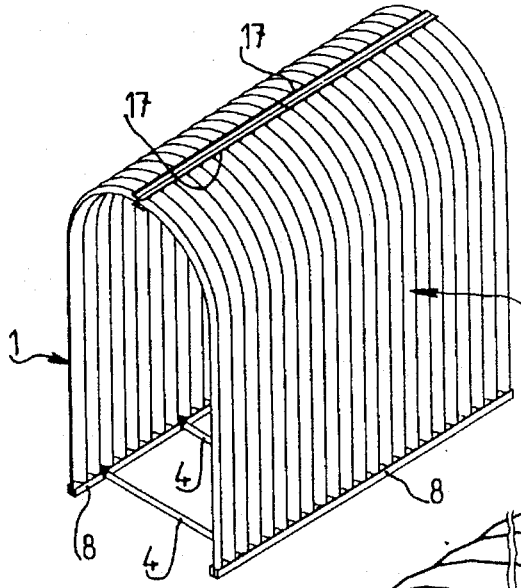
FIG. 1 shows as a perspective view the device forming a protective shelter according to the invention.
Figure 2:
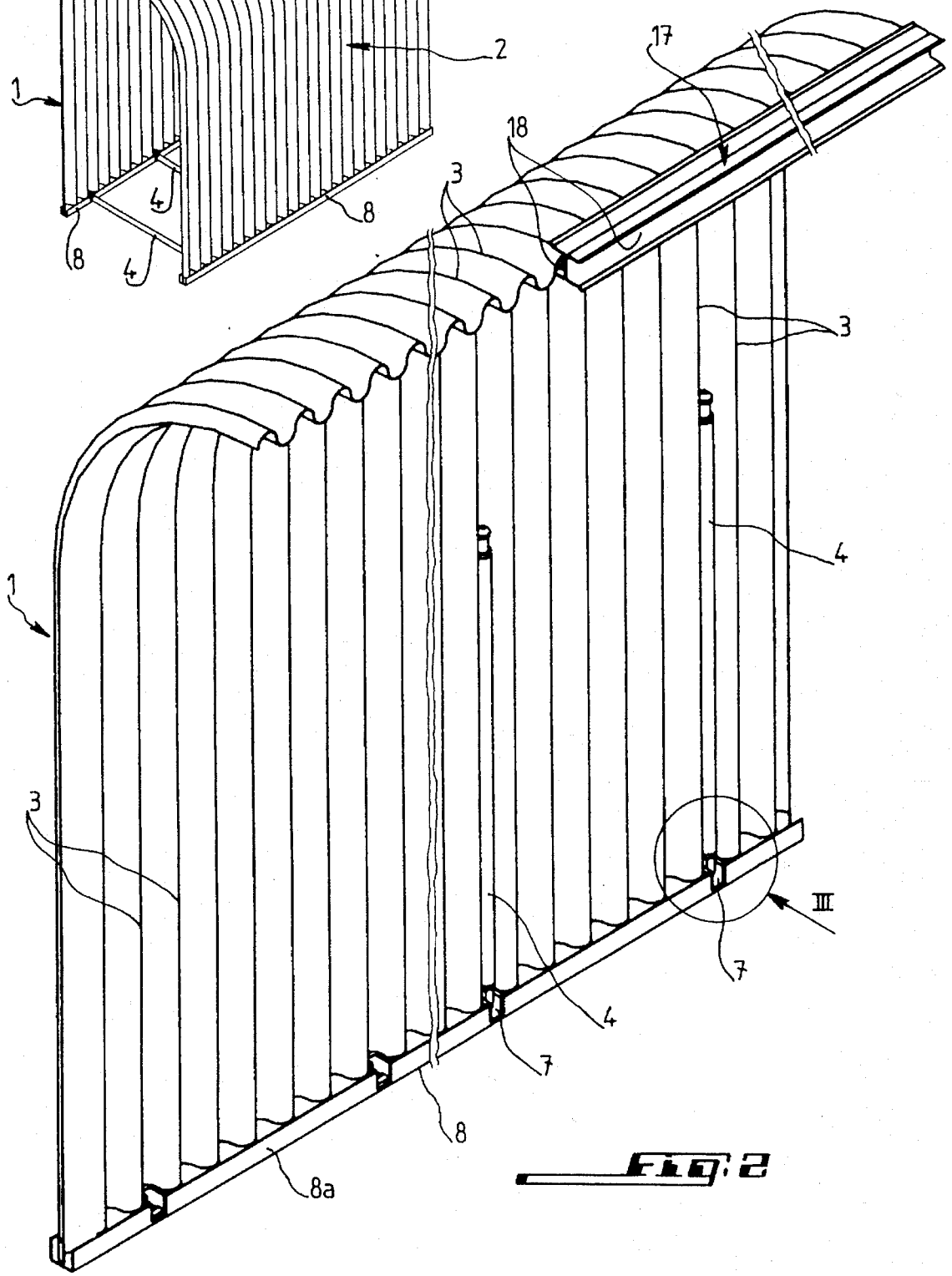
FIG. 2 shows as an enlarged perspective view one panel of the device of the invention.

The device of the invention which is intended to form an underground shelter for the protection of persons comprises as this appears in particular from FIG. 1 two substantially identical rigid panels 1 and 2 assembled together into a tunnel configuration which may be disassembled and has parallel side walls and a vault shaped as a cylindrical cap.

For that purpose each panel 1, 2 which is defined by a series of parallel corrugations or flutes 3 in the manner of a corrugated or fluted metal sheet and are located in vertical planes in the assembled position of both panels, comprises two elements forming cross-members 4 with the same length and having each one of their ends fastened in a pivotally connected manner to the upper part of the panel 1, 2 so as to be pivotable in a plane substantially perpendicular to the plane containing the side wall of the panel 1, 2 between an inoperative position of storage into the hollow valley defined between two successive corrugations and a downwards swung position for fastening both lower parts of the panels 1, 2 to each other, in which the cross-member elements are located in a same plane forming the supporting bottom of the shelter.

Figure 8:
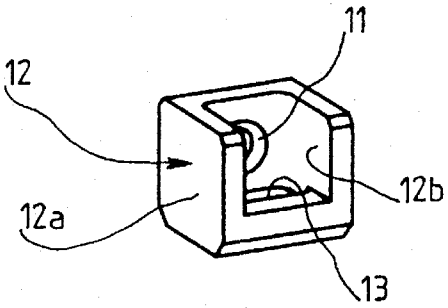
FIG. 8 is an enlarged perspective view of an affixed piece forming part of the device of the invention.
Figure 9:
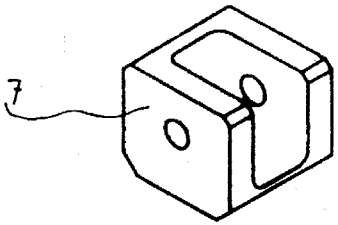
FIG. 9 is an enlarged perspective view of another affixed piece also forming part of the device of the invention.
Figure 7:
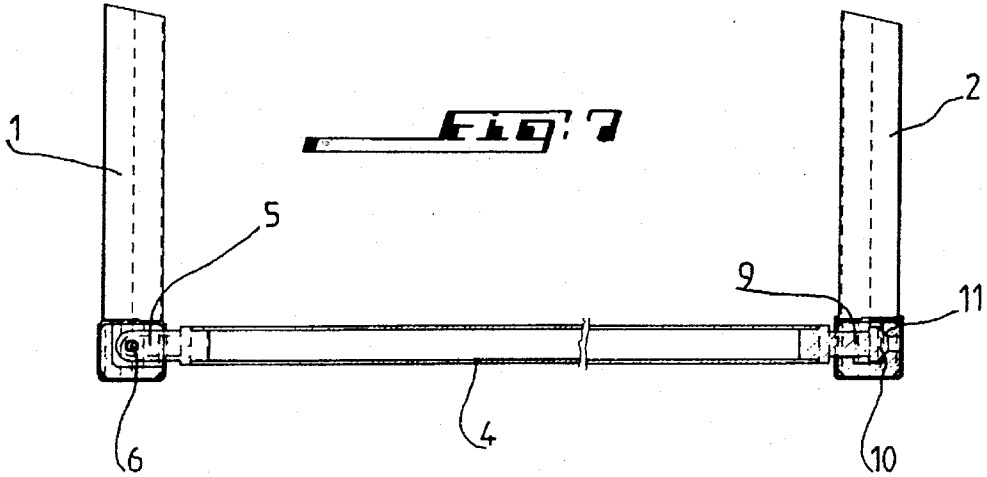
FIG. 7 is a view in cross-section taken upon the line VII—VII of FIG. 4.
Figure 10:
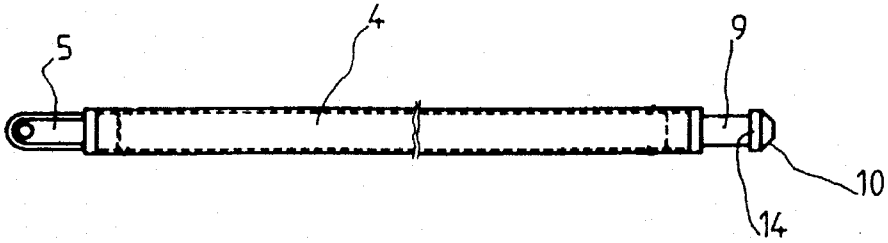
FIG. 10 shows a cross-member element of the device of the invention.
Figure 14:
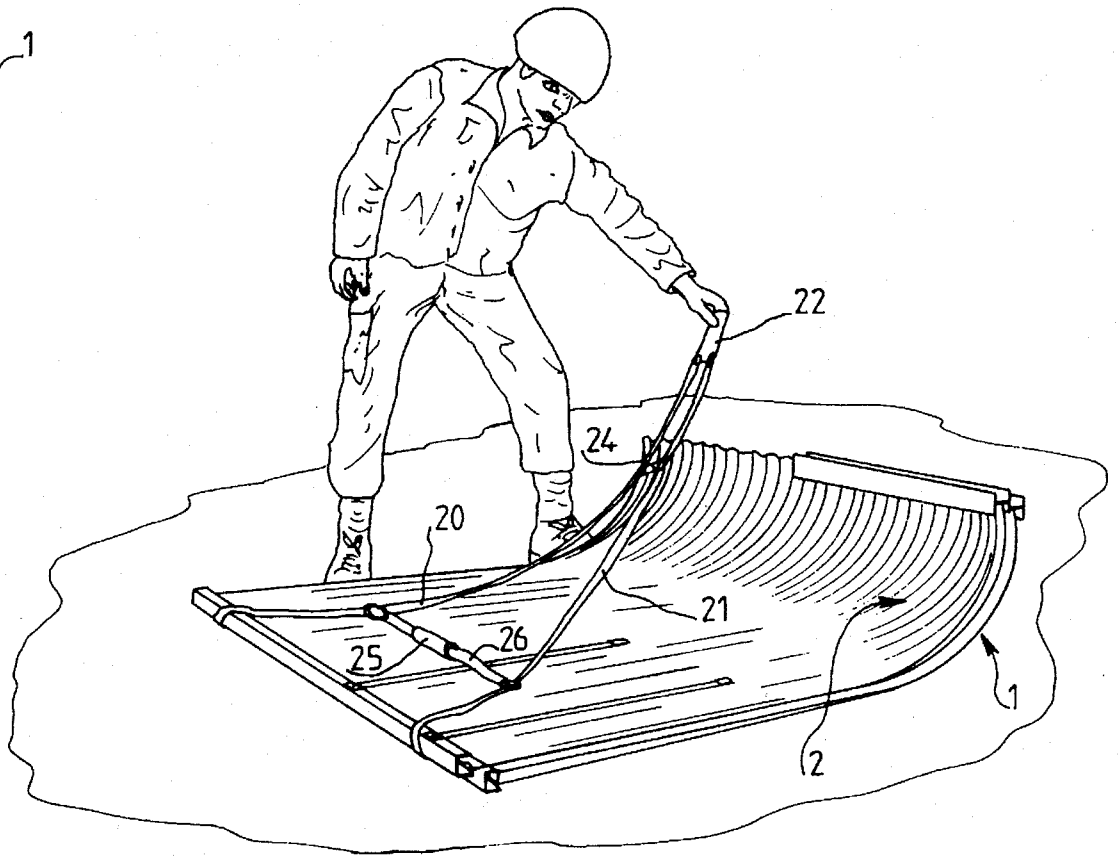
FIGS. 13 through 18 show the transport and building phases of the device forming the underground shelter of the invention.

More specifically the pivotally connected end of each cross-member element 4 comprises an end portion 5 forming a lug for pivotal connection fastened for example by being force-fitted or pressed into the tubular body of the element 4 and pivotally mounted about a pin 6 fastened into a yoke-shaped clevis part 7 affixed to the bottom portion of the corresponding panel 1, 2. The end portions 5 instead of being force-fitted may also be welded or mechanically connected. Each yoke-shaped part 7 is fastened for example as by welding between two parallel walls or flanges **8*a*, 8*b* of a channel-like sectional member defining a longitudinal girder or stringer 8 into which are fastened for example by rivets the lower portions of the corresponding panel 1, 2. Each side wall 8*a* of a girder 8 comprises a U-shaped shaped cut-out or recess 8*a*1 located in front of the yoke-shaped part 7 so as to permit the pivoting of the cross-member element 4 to the position of fastening of both panels 1, 2 wherein the element 4 is substantially perpendicular to the girder 8. The opposite end of each cross-member element 4 comprises an end portion 9 fastened for example by being force-fitted or pressed into the tubular body of the element 4 and terminating into a frusto-conical portion 10 engaging a mating or complementary frusto-conical recess 11 formed in a piece 12 which is affixed to the lower portion of the corresponding panel 1, 2. As shown in particular on FIG. 8, the piece 12 has approximately the shape of a recess or hollowed out cube so as to permit the passage of the end portion 9 from above into the piece 12 upon the pivoting of the cross-member element 4 to the positioning of fastening both panels 1, 2. The part 12 comprises a stop or abutment wall 13 formed in the bottom wall of the part 12 between two side walls 12*a*, 12*b* of the part 12 in perpendicular relation to the latter. The stop or abutment wall 13 co-operates with a collar 14 located behind the frusto-conical portion 10 of the end portion 9 so as to prevent the withdrawal of the end of the cross-member element 4 from the part 12 when an accidental force is applied to the element 4 in a direction tending to move the end part 9 away from the part 12. The latter is also fastened for example as by welding into the corresponding girder 8 the side wall 8*a* of which comprises a U-shaped notch 8*a*2 in front of the corresponding recessed portion with a U-shaped cross-section of the part 12 so as to permit the free passage of the end part 9 into the part 12 from above the latter to accommodate the frusto-conical portion 10 into its corresponding opening 11. Each cross-member element 4 is kept in the inoperative position by two elastic legs 15 approximately defining a Ω-shape and fastened at the bottom of a valley between two successive corrugations 3 for example by a rivet 16. Both legs 15 receive the corresponding end part 9 by spreading elastically from each other and are then closing to clamp or hold the element 4** in the inoperative position.

The figures show that the device comprises four cross-member elements but it should be understood that it is possible to provide a higher or lower number thereof. Moreover two of the elements 4 are fastened in a pivotally connected manner to one of the girders 8 whereas the two other elements 4 are fastened in a pivotally connected manner to the other girder 8. It is also possible to alternately fasten in a pivotally connected manner elements 4 to both girders or merely to fasten in a pivotally connected manner all the elements 4 to a same girder 8.

Figures 3, 4, 5, 6:
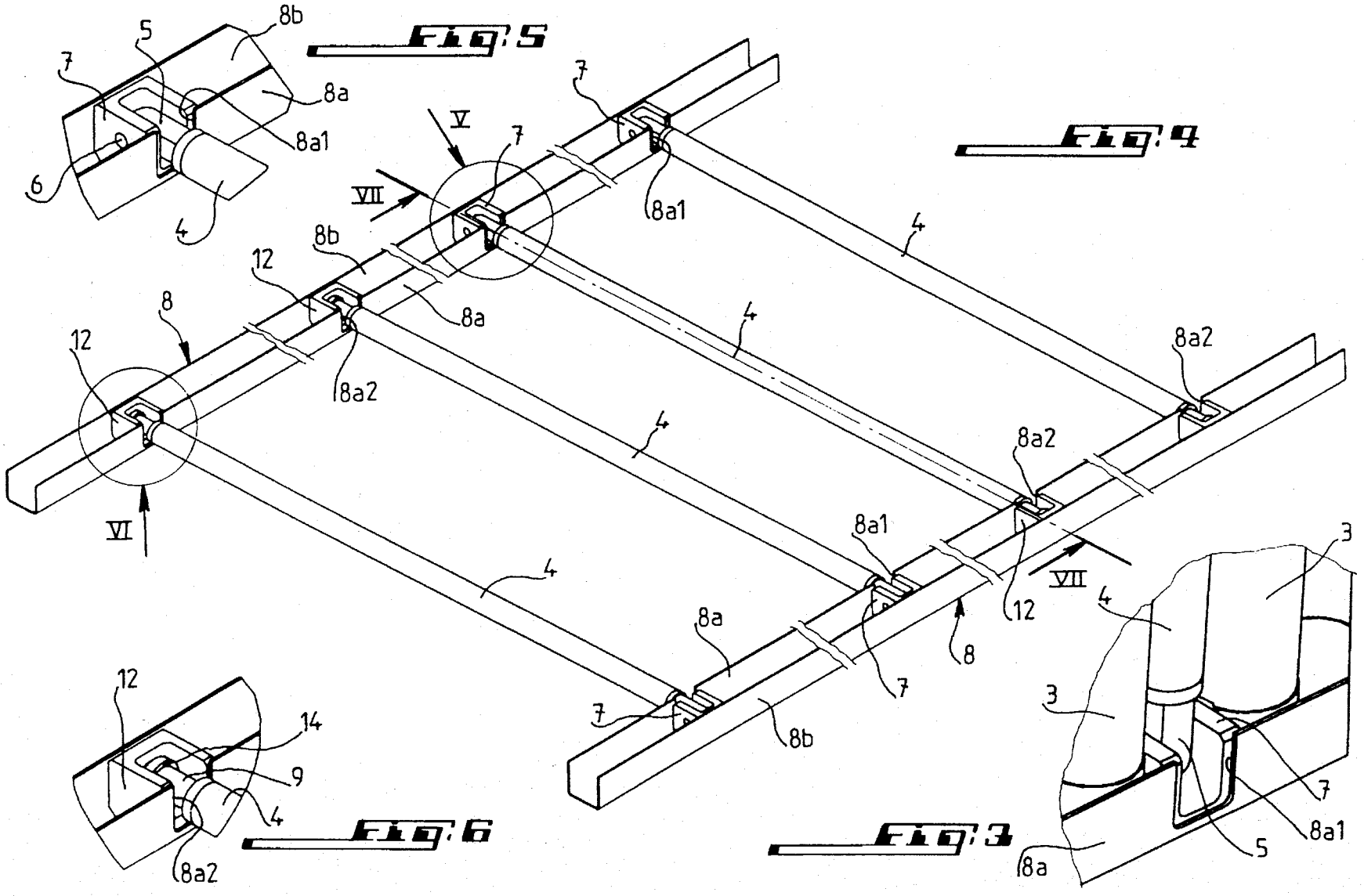
FIG. 3 is an enlarged view of the portion circled at III on FIG. 2.
FIG. 4 is an enlarged perspective view of the frame for supporting the device of the invention.
FIG. 5 is an enlarged view of the portion circled at V on FIG. 4.
FIG. 6 is an enlarged view of the portion circled at VI on FIG. 4.

FIG. 4 shows that the parallel girders 8 and the cross-member elements 4 assembled between the girders in perpendicular relation thereto form a rigid supporting frame for both panels 1, 2.

To allow the assembly of the upper parts shaped as half arches of both panels 1, 2, each panel comprises a beam 17 with two opposite side grooves 18 preferably defined by two identical channel-like sectional members made fast together with their base webs for instance as by welding. The top end of the half arch of each panel is fastened over one portion of its length into one of the grooves 18 of the beam 17 for example by rivetting. Preferably the beam 17 extends over one half of the total length of the corresponding panel 1, 2. The other groove or channel 18 of the beam 17 of one panel is intended to receive the corresponding top end portion of the other panel. The beam 17 of this latter panel also receives into its corresponding channel or groove 18 the free top end portion of the first panel. In the assembled position of both panels, both beams 17 are aligned in close order or joined relationship.

Both panels 1, 2 may be fitted over one another as shown on FIG. 11 to permit their transport by a person to the place where the shelter should be buried. In the interfitted position of these two panels, the beam 17 of the outer panel 1 is resting upon the beam 17 of the inner panel 2 whereas the girder 8 of the panel 1 is bearing upon the girder 8 of the panel 2. The panels 1, 2 are held in interfitted position by a harness 19 also serving as a means for transporting the nested panels 1, 2. The harness 19 comprises two laces 20, 21 made from a flexible or yielding material and connected together at the top part to a common flexible tie brace 22 removably fastened to the beam 17 of the external panel 1 and fastened at their two spaced bottom ends to the girder 8 of the external panel 1. The fastening of the brace 22 may be carried out through the medium of a small pin or stud 23 made fast to the beam 17 of the panel 1 and of a hole extending through the brace 22 and into which is inserted the pin or stud 23. The fastening of both ends of the laces 20, 21 to the girder 8 may be effected by means of rivets. The harness 19 also comprises a strap 24 made from a flexible or yielding material and located at the top portion thereof and an handling or carrying handle 25 fastened between both laces 20, 21 at the lower portion thereof through the medium of a tie strip 26. The strap 24 and the handle 25 are located at such a distance from each other so as to permit a person to carry both nested panels by means of the handle 25 while having the strap 24 positioned below his arm. The strap 24 allows to avoid the tilting outwards of the body of the person about the handle 25 of the nested panels and to convey the panels in a slightly inclined position with respect to the body of the person.

In order that the assembled panels 1, 2 be light, the cross-member elements 4, the girders 8, the beams 17 and the affixed parts 7, 12 are preferably made from aluminum.

The setting up of the device forming an underground shelter already results from the description thereof which has been made hereinabove and will now be explained with reference to FIGS. 13 to 18.

Figure 13:
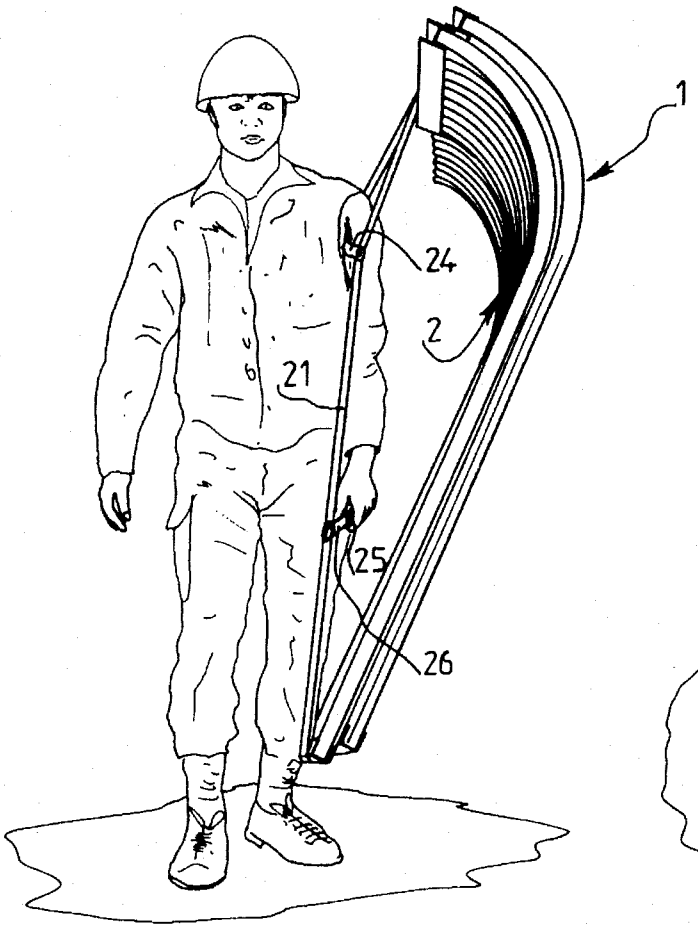
Figure 16:
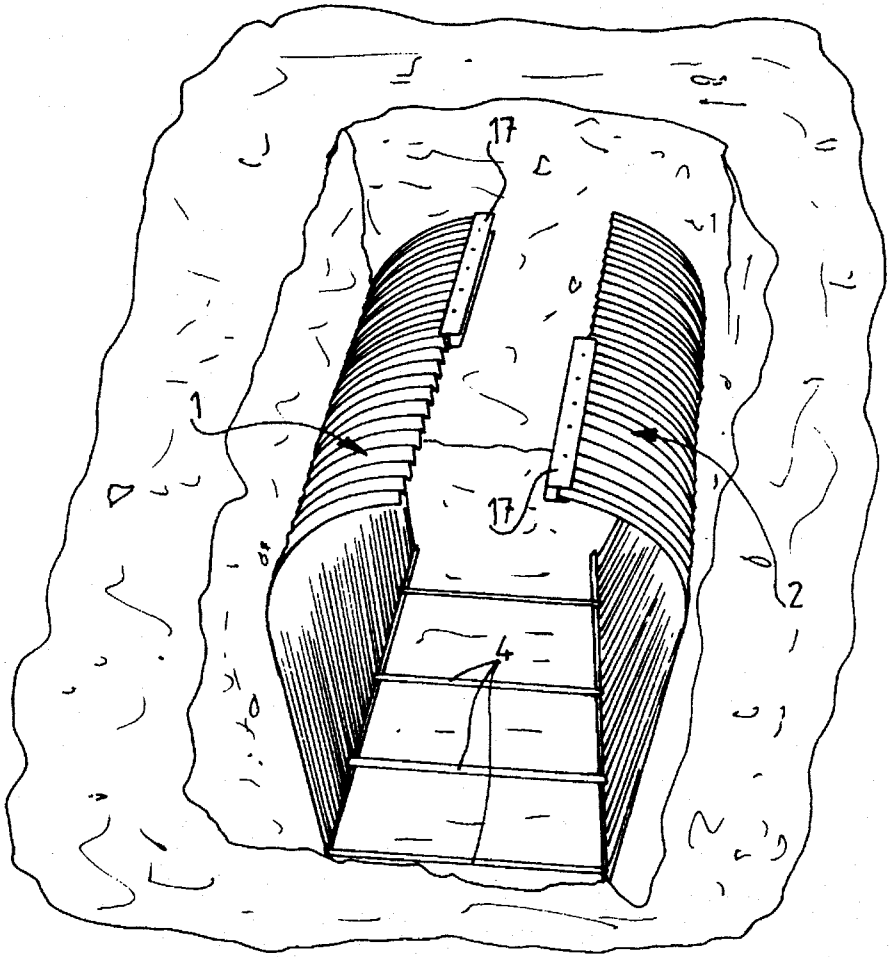
Figure 15:
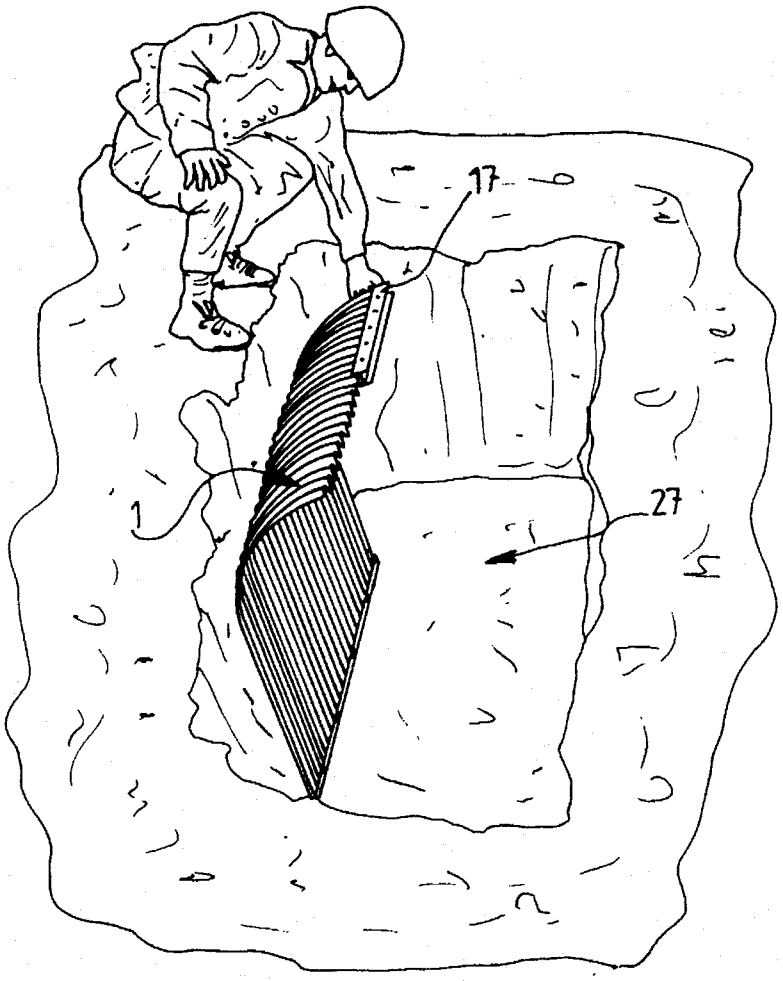
Figure 18:
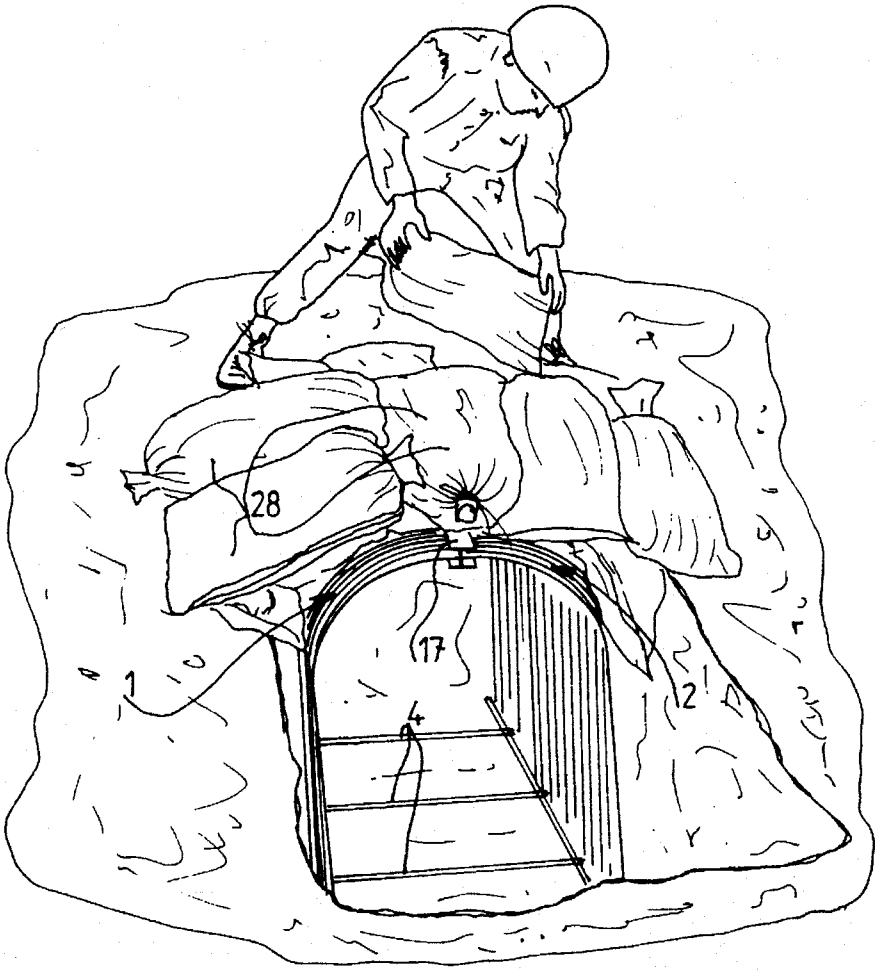
Figure 17:
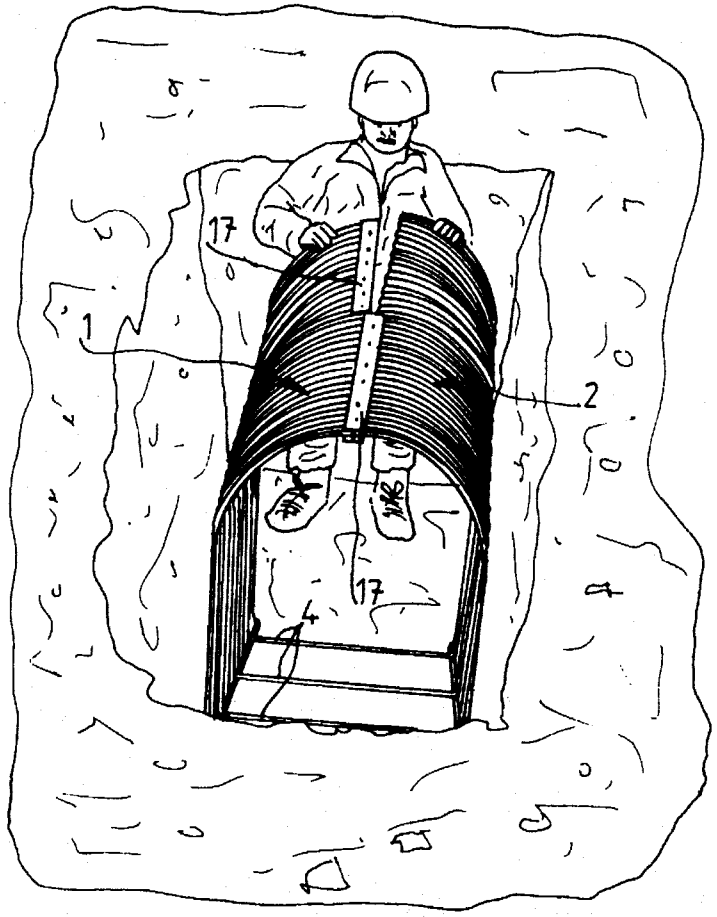

FIG. 13 specifically shows the position of transport of both nested panels 1, 2 by one person proceeding to the place where the device has to be buried. Upon arrival at that place, the person separates both panels 1, 2 from each other by disconnecting the tie brace 22 from its pin or stud 23 fastening it to the panel 1 as shown on FIG. 14. After having dug out an excavation 27 of suitable size the person would successively insert both panels 1, 2 into the excavation 27 in a substantially vertical position and put in place the four cross-member elements 4 by swinging them downwards in the clockwise direction as this appears from FIGS. 15 and 16. The frusto-conical ends 10 of the cross-member elements 4 are then inserted into their respective frusto-conical openings 11. Then as shown on FIG. 17, the top portions shaped into a half arch of the panels 1, 2 are joined together through fitting into their respective beams 17 for making the tunnel-like shelter. After having made sure that the cross-member elements are properly locked in their corresponding affixed parts, the shelter would be covered with earth and protective bags 28 as shown on FIG. 18.

The shape and the structure of the panels 1, 2 and of the cross-member elements 4 are made optimum to allow the shelter to withstand the side thrust of very unstable grounds and the thrust of the ground exerted in particular upon the side walls of the panels 1, 2 of the buried shelter would contribute to firmly retain the frusto-conical ends of the cross-member elements 4 within their corresponding frusto-conical openings. Moreover the shape of the panels 1, 2, the interfitting of their upper portions and the lower connections thereof permit to obtain under the action of the pressure of the earth upon the top and the sides of the panels, a self-locking device providing a full safety to the persons. The simplicity of the means used to assemble the shelter as well as the sturdiness of the latter allow a great number of dismantlings for successive uses of the shelter and the shape and length of this shelter are compatible with the use of light weapons. The shelter allows to easily receive two persons and is readily transportable by one single person since the weight of the panels nested in the transport position is at most about 17 kilogrammes. Experimentations with the shelter buried under an earth layer about 60 cm thick have permitted to verify that the shelter withstands the effects of a shell of 155 mm. Conclusive tests comprised an explosion in the air with prevailing shell splinters, an explosion in the air with a prevailing pressure and a terrestrial explosion of prevailing seismic character.

What is claimed is:

1. A device forming an underground shelter for the protection of at least one person, said device comprising:

substantially identical first and second rigid panels assembled together into a tunnel-like configuration, each of said panels having a bottom portion and a top portion;

first mechanical means fixed to said top portion of each of said panels, said first mechanical means of said first and second panels interfitting said top portions of said second and first panels, respectively; and second mechanical means fixed to said bottom portion of said panels for providing a rigid connection between said bottom portions of both panels, said second mechanical means comprising at least two elements forming cross-members with the same length, said elements each having first and second ends, said first ends of said elements pivotally connected to the bottom portion of one said panels and said second ends removably fastened to the bottom portion of the other panel, wherein the second end of each cross-member element comprises a frusto-conical end portion insertable into a mating frusto-conical aperture of a part affixed to the bottom portion of the other panel, the frusto-conical end portion being firmly held in said aperture by a transverse thrust force of earth covering said shelter.

2. A device according to claim 1, wherein the aforesaid affixed part comprises one abutment portion co-operating with a collar made fast to the frusto-conical end portion behind the latter for holding the cross-member element against motion with respect to the corresponding panel.

3. A device according to claim 2, wherein the affixed part has approximately the shape of a recessed cube so as to permit the insertion of the end of the cross-member element into that part from above the latter and wherein the abutment portion is provided in the bottom wall of the cube of the affixed part and extends in perpendicular relation to and between the side walls of the cube transversely of the corresponding panel whereas the frusto-conical aperture is formed in that end wall of the cube which is adjacent to the panel.

4. A device forming an underground shelter for the protection of at least one person, said device comprising:

substantially identical first and second rigid panels assembled together into a tunnel-like configuration, each of said panels having a bottom portion and a top portion;

first mechanical means fixed to said top portion of each of said panels, said first mechanical means of said first and second panels interfitting said top portions of said second and first panels, respectively; and second mechanical means fixed to said bottom portion of said panels for providing a rigid connection between said bottom portions of both panels, said second mechanical means comprising at least two elements forming cross-members with the same length, said elements each having first and second ends, said first ends of said elements pivotally connected to the bottom portion of one said panels and said second ends removably fastened to the bottom portion of the other panel, wherein each cross-member element is movable in a plane perpendicular to that of the panel to which it is pivotally connected from an operative position wherein its second end is removably fastened to the bottom portion of the panel to which it is not pivotally connected, to an inoperative position wherein it rests vertically against the panel to which it remains pivotally connected when said first and second panels are separated.

5. A device according to claim 4, wherein the cross-member element is retained in the inoperative position by two elastic approximately Ω-shaped legs fastened to the panel and receiving the end with the frusto-conical portion of the cross-member element.

6. A shelter comprising:

substantially identical first and second rigid panels, each of said panels having a bottom portion and a curved top portion, said first and second panels arranged in a tunnel-like configuration with said top portions being connected to one another and said bottom portions being spaced apart and substantially parallel to one another;

first mechanical means connecting said top portions by interfitting top ends of each of said top portions; and second mechanical means for providing a rigid connection between said bottom portions, said second mechanical means comprising at least a first and a second cross-member, each cross-member being pivotally connected to one of said panels and movable from an operative position wherein said each cross-member is removably fastened to a respective other of said panels to provide said rigid connection, to an inoperative position wherein said each cross-member rests vertically against the panel to which it remains pivotally connected when said first and second panels are separated.

7. The shelter of claim 6, wherein both panels are nested into each other in a position of transport to a place of burying by one person and wherein it moreover comprises a harness for the transport of both nested panels.

8. A device according to claim 7, wherein the aforesaid harness is arranged for at the same time holding both panels nested into each other during the transport and for permitting their transport in a position maintained slightly inclined with respect to the body of the person.

9. A device according to claim 8, wherein the harness comprises two laces for the fastening of both nested panels, connected together at the upper portion by a common tie-brace removably fastened to the beam of the external panel and fastened at their two spaced lower ends to the beam of the external panel; an upper strap fastened between both laces and a lower handling handle also fastened between both laces at such a distance from the strap so that the person can transport the nested panels by grasping the handling handle with the strap accommodated under his arm.

10. The shelter of claim 6 wherein said first and second cross-members have the same length and are pivotally connected to one of said panels at a bottom portion thereof and are removably fastened to the bottom portion of the other of said panels.

11. The shelter of claim 10 wherein said each cross-member is pivotally connected to said one of said panel by a yoke-shaped structure.

12. The shelter of claim 10 wherein each panel comprises corrugations and is formed from a glass fiber-based material.

13. The shelter of claim 6 further comprising a first girder having a U-shaped cross-section fastened to the bottom portion of said first panel and a second girder having a U-shaped cross-section fastened to the bottom portion of said second panel, said girders and said cross-members providing a supporting frame for said panels when said cross-members are in said operative position.

14. The shelter of claim 13 further comprising channel-like recesses formed in mutually confronting side walls of said girders to permit the fastening of said each cross-member between the panels in a plane perpendicular to the panel to which said each cross-member is pivotally connected.

15. The shelter of claim 6 wherein said first mechanical means comprises at least one beam having two opposite grooves, said top ends being interfitted into said grooves.

16. The shelter of claim 6 wherein said first mechanical means comprises two identical beams, each beam having a groove and extending along one-half the length of a respective top end and fixed thereto, a free half of one top end being interfitted into the groove of the beam fixed to the other top end.

17. The shelter of claim 6 wherein said first and second panels have a combined weight of less than 20 kilograms.

18. The shelter of claim 6 wherein said top portion of each panel has the shape of one half arch and said shelter has a cylindrical cap when said top portions are connected.

19. A method for erecting a shelter comprising the steps of:

providing a shelter assembly, said assembly comprising:

substantially identical first and second rigid panels nested together, each of said panels having a bottom portion and a curved top portion;

first mechanical means for connecting said top portions by interfitting top ends of each of said top portions; and second mechanical means for providing a rigid connection between said bottom portions, said second mechanical means comprising:

at least a first and a second cross-member, each cross-member being pivotally connected to the bottom portion one of said panels and occupying a rested inoperative position wherein it rests vertically against the panel to which it remains pivotally connected;

separating said nested panels from each other;

arranging said panels in a substantially vertical position with said bottom portions being spaced apart and substantially parallel to one another, said top ends brought together;

pivoting said each cross-member on the panel to which it is pivotally connected from said rested inoperative position to an operative position wherein it releasably engages the bottom portion of the panel to which it is not pivotally connected; and interfitting said top ends into said first mechanical means.

* * * * *

UNITED STATES PATENT AND TRADEMARK OFFICE
CERTIFICATE OF CORRECTION

PATENT NO. : 5,611,178

DATED : March 18, 1997

INVENTOR : Henri AUBERT

It is certified that error appears in the above-identified patent and that said Letters Patent is hereby corrected as shown below:

On the title page, item [30]: "Foreign Application Priority Data", change "Aug. 4, 1994" to --April 8, 1994--.

Signed and Sealed this

Twenty-sixth Day of August, 1997

*Attest:*

*Attesting Officer*

BRUCE LEHMAN

*Commissioner of Patents and Trademarks*